US005538106A

United States Patent [19]

McHugh et al.

[11] Patent Number: 5,538,106

[45] Date of Patent: Jul. 23, 1996

[54] ROTATIONALLY STIFF ELEVATOR CAR DOOR COUPLING

[75] Inventors: Thomas M. McHugh; Thomas M. Kowalczyk, both of Farmington; Richard E. Kulak, Bristol; Thomas He, Unionville; Edward E. Ahigian, West Hartford; Jerome F. Jaminet, South Windsor; Richard E. Peruggi, Glastonbury; David W. Barrett, East Hartland, all of Conn.

[73] Assignee: Otis Elevator Company, Farmington, Conn.

[21] Appl. No.: 224,435

[22] Filed: Apr. 8, 1994

[51] Int. Cl.[6] ..... B66B 13/00

[52] U.S. Cl. ..... 187/330; 49/120

[58] Field of Search ..... 187/330, 319; 49/120, 122

[56] References Cited

U.S. PATENT DOCUMENTS 3,783,977 1/1974 Voser ..... 187/319

4,947,964 8/1990 Husmann ..... 187/319

*Primary Examiner*—Kenneth Noland

[57] ABSTRACT

A coupling for causing an elevator car door to engage an elevator hoistway door includes a pair of vanes, each end of each vane pivoted on a link connecting it with the other vane, the links being disposed for rotation between said two vanes on an elevator car door thereby forming a parallelogram. The vanes extend vertically between four rollers which rotate about horizontal axles disposed at the top of the hoistway door, and which provide rotationally stiff coupling. A solenoid actuator can move one vane up to cause the parallelogram to shrink, into an uncoupled position. When the actuator is disenergized, a spring causes the parallelogram to spread so that the vanes are wedged between the rollers and the two doors are coupled together.

6 Claims, 2 Drawing Sheets

ROTATIONALLY STIFF ELEVATOR CAR DOOR COUPLING

TECHNICAL FIELD

This invention relates to rotationally stiff coupling of a hoistway door of an elevator to an elevator car door for opening and closing in unison with and by the motion of the elevator car door, which mitigates door rocking and rotational perturbations.

BACKGROUND ART

Modern elevator systems have doors to permit transfer of passengers between the elevator cars and the respective floor landings. Because smaller doors have to travel a lesser distance and have less inertia, many elevators have two doors. They may meet in the middle, and thereby have a lesser distance to travel or they may both travel to the same side for opening. Other elevators may have only a single door. As used herein, the term "door" or "doors" may be used interchangeably, it being understood that there is no distinction between a single door and double doors concerning the subject matter hereof.

Present day elevator systems have doors mounted on the elevator car, and doors mounted at each hall landing of the elevator hoistway. The hoistway doors at the hall landings are mounted directly to the building structure, and are kept closed whenever the car is not present at the related landing in order to prevent passengers and objects from entering the hoistway. Instead of having door operators for each of the hoistway doors, the hoistway doors are typically opened by coupling them with the car doors, so that opening of the car doors will open the hoistway doors in unison therewith, thereby protecting passengers in the car from the building structure and protecting passengers at the landing from the hoistway.

The manner of coupling the doors together must take into account several factors. The doors usually begin to open just before the car reaches the landing (such as 10 or 15 centimeters therefrom), resulting in relative vertical motion between the elevator door and the hoistway door as the elevator approaches the landing. A similar constraint is that the car may be releveled after the doors are open, which also requires permissible relative vertical motion between the car doors and the hoistway doors. The hoistway doors may easily be pushed open by the elevator doors, but they must also become closed, either by being pulled (or pushed) toward the closed position by the elevator doors, or by some biasing in the closed direction. Biasing in the closed direction may take the form of a spring, a weight or aspirator. However, any bias in the closed direction must be overcome by the force exerted by the elevator doors during the opening process. Similarly, any perturbations in the bias during the opening process will in turn provide perturbation in the control algorithm for the elevator door opening system. Therefore, it is deemed preferable to have the hoistway doors opened and closed by the elevator doors, with only enough separate bias to satisfy automatic door closure required by safety codes.

A typical coupling device employs a rigid vane mounted on the car door which engages a rotatable pawl from the hoistway door, the pawl having rollers thereon so that the vane can travel upwardly or downwardly while engaging the pawl. Typically, there may be some lost motion between the two doors; that is, the car door must begin to open before it engages the pawl, unlocking the hoistway door, and commencing to push the hoistway door, through the pawl, in the open direction. When closing, the hoistway doors must be fully latched before the car door motion stops (before the car doors are fully closed). In some assemblies, the rollers move into contact with the vane before motion, and in others, the vane is expanded to contact the rollers before any motion. However, devices of this type are wear and adjustment sensitive and require frequent adjustments and replacements over the life span of an elevator system.

Whenever there is a change in the amount of force required to move an elevator car door, either because of lost motion between it and a hoistway door, or because of a change in the mechanism leverage and the like, perturbations of the electrical control system which is providing the motive force for the car door opening mechanism can result. This in turn can cause vibrations and other mechanical perturbations thus resulting in additional wear and noise. In fact, for door control mechanisms which have closed velocity loop electrical control systems, horizontally stiff coupling is required throughout the full range of door motion. For door couplings which have lost motion, that is, the two door sets are de-coupled during some range (between 1 and 3 centimeters) of car door motion, the hoistway doors must rely on a weight closer (or other biasing device) to fully close the hall doors. And, in very tall buildings, door closing (particularly at the lobby) can be erratic due to hoistway air pressure (called "windage" or "chimney effect"), unless the hoistway doors are closed positively.

Another desired feature is that the edges of the hoistway doors be flush with the edges of the car doors, as a consequence of being opened completely in unison.

Of course, any coupling mechanism located on a particular hoistway door must have complete clearance, for all of the apparatus, including the corresponding parts of a coupling device which are mounted on the car doors, so that elevators that are simply passing by landings do not run the risk of contact with the hoistway door coupling devices.

Another difficulty with elevator car doors is that should there be any electrical devices mounted on the car door, then there need be electrical wires having an extremely high number of flexure cycles over a relatively short period of time, requiring additional maintenance.

Typical door operating devices known to the art utilize rotary motors together with gearing, chains and levers to actuate the elevator car door. The point of applying opening and closing force to the car door has typically been chosen to be near the center of gravity, in order to avoid inducing rocking into the door, which creates noise and excessive wear. As a consequence, coupling devices typically have been located at or near the center of gravity, sometimes just above the center of gravity, of the doors. A door system of this general type is shown in U.S. Pat. No. 5,005,673, and includes two vanes on the car door that separate to become wedged between two rollers on the hoistway door; the separation is caused by motion of the car door, working against a fixed cam. The coupling system of that patent provides lateral stiffness, that is, a stiff coupling in the direction of opening and closing of the doors.

Disclosure of Invention

Objects of the invention include provision of a coupling between an elevator car door and a hoistway door which has a high degree of rotational stiffness between the car door and which reduces rocking and rotational perturbations throughout the full range of door motion.

This invention is predicated in part on the fact that door coupling near the center of gravity of the doors causes rotational perturbations in an elevator door operating system which employs a linear induction motor operating at the top of the door. The invention is predicated partly on the discovery that coupling of a hoistway door to be driven by an elevator car door should be made as closely as possible to the area of application of motive force to the car door in order to reduce rocking and rotary perturbations of the doors. The invention is predicated in part on the discovery that the operation of elevator car doors by application of motive force at the top of the car door requires door couplers which have greater rotational stiffness than that which is provided by door couplers known to the prior art.

According to the present invention, rocking and other rotational perturbations in an elevator car door, which is opened and closed by imparting force to the top of an elevator car door to which there is coupled an elevator hoistway door for movement in unison with and in response to the motion of the elevator car door, are mitigated by a rotationally stiff elevator door coupling device which comprises at least four bumpers, such as rollers, disposed on one of the doors for transmitting force between such door and vanes disposed on the other of the doors.

According to a second aspect of the present invention, rocking and other rotational perturbations in an elevator car door, which is opened and closed by imparting force to the top of an elevator car door to which there is coupled an elevator hoistway door for movement in unison with and in response to the motion of the elevator car door, are mitigated by disposing the door coupler as close as possible to the area of the elevator car door where the motive force is imparted thereto. According further to the invention, force is transferred between an elevator car door and a hoistway door, so as to operate them in unison in response to the motion of the elevator car door, by means of a rotationally stiff door coupler disposed as close as possible to the area of application of force to the elevator car door, eliminating rocking and rotational perturbation in the doors, and providing very smooth door operation with negligible perturbations feeding back into the door motion control system.

Although devised for and disclosed in conjunction with a linear induction motor elevator door operating system, the invention may be used with other door drives to advantage, utilizing the features and teachings of the present invention.

According to one embodiment of the invention, a pair of vanes disposed at the top center of an elevator car door are forced apart so as to become wedged between bumpers that extend outwardly into the hoistway from the top center of an elevator hoistway door at a landing where the elevator car is making a stop, thereby coupling the doors together.

The vanes readily slide vertically along the bumpers, due to the bumpers comprising low friction slide surfaces or rollers, thereby allowing advance door opening (commencing to open the door just before the elevator reaches the landing), and releveling of the elevator, even after the doors are fully open.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
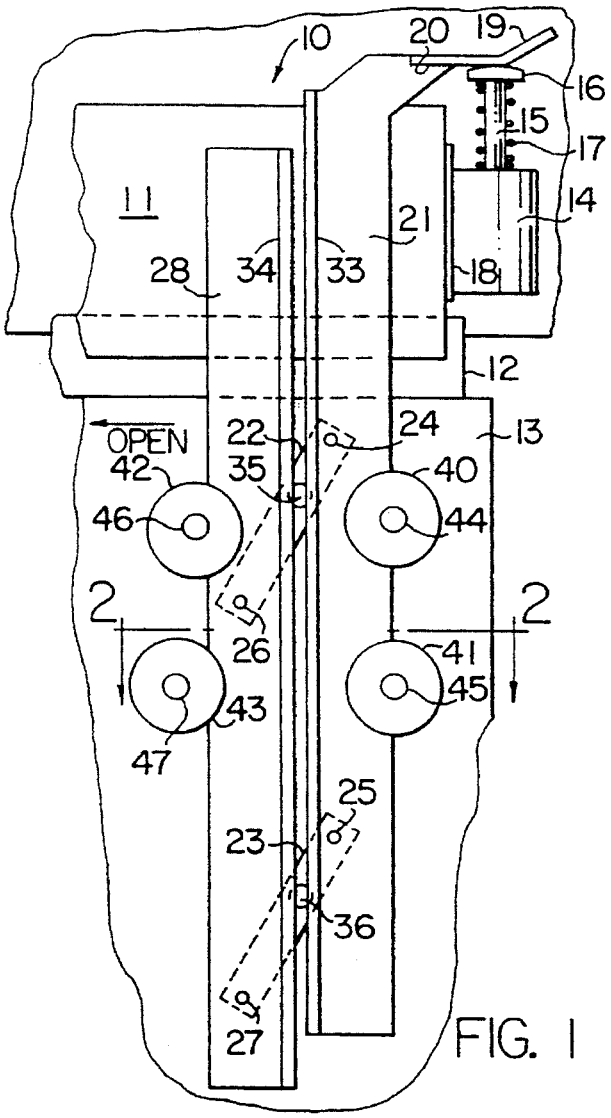
FIG. 1 is a partial, front elevation view taken on the line 1—1 of FIG. 2 of a door coupler of the invention on an elevator car door, in the uncoupled position.
Figure 2:
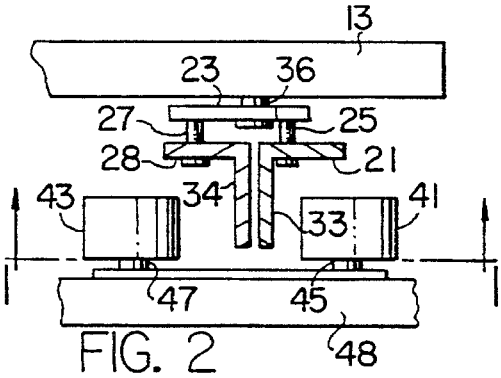
FIG. 2 is a partial, partially sectioned top plan view taken on the line 2—2 of FIG. 1, showing the coupler in the uncoupled position.
Figure 3:
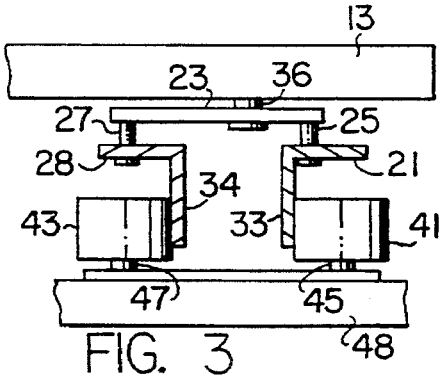
FIG. 3 Is a top plan view, partially sectioned, similar to FIG. 2 but showing the coupler in the coupled position.

Referring now to FIG. 1, an elevator car 10 has a linear induction motor 11 disposed thereon so as to operate a secondary 12 thereof which is secured in some fashion to an elevator car door 13 so as to cause the door to open and close, in response to suitable demand. The door 13 is shown in its fully closed position, and actuation of the linear induction motor 11, 12 will cause the door to move toward the left as seen in FIG. 1, into the open position. Attached to the primary 11 of the motor is a solenoid actuator 14, the armature 15 of which is connected to a cap 16 which is normally forced upward (in FIG. 1) by a spring 17. With the cap 16 in the position shown in FIG. 1, it is in contact with a shelf 20 on an angle 21 which is disposed to a pair of links 22, 23 by corresponding pivots 24, 25. The other end of each link 22, 23 is connected by pivots 26, 27 to another angle 28. The angles 21 and 28 (as seen in FIGS. 2 and 3) in this embodiment may be angles with about equal legs. The solenoid actuator 14 is mounted on a bracket 18 that brings it forward of the front edge of the motor primary 11; the shelf 20 similarly extends forward of the angle 21. The shelf 20 is bent to form a ramp 19. The legs, shown edgewise in FIG. 1, comprise substantially vertically disposed parallel vanes 33, 34. Each link 22, 23 is disposed by a corresponding pivot 35, 36 to the elevator car door 13.

Figure 4:
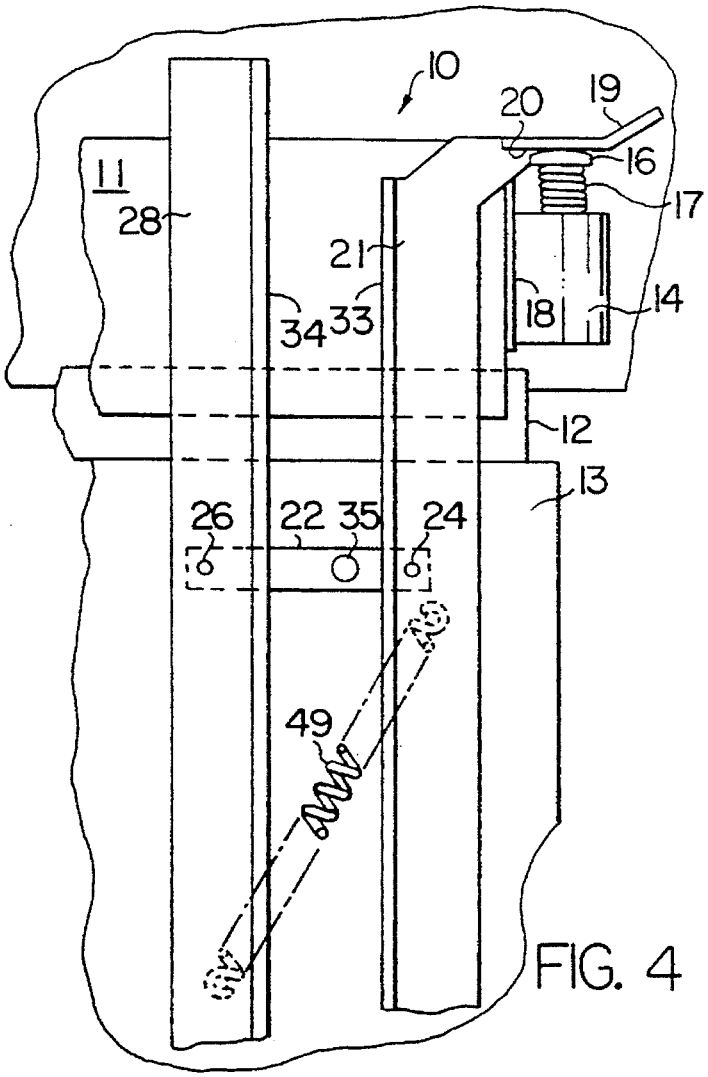
FIG. 4 is a partial, front elevation view of the apparatus of FIG. 1 in the coupled position.

Downward actuation of the solenoid actuator 14 as seen in FIG. 4, will allow the links 22, 23 to rotate about the pivots 35, 36 causing the vane 33 to be lowered and the vane 34 to be raised, into the positions shown in FIG. 4. This will cause the vanes 33, 34 to be wedged (FIG. 3) between a plurality of bumpers, such as rollers 40–43, which are mounted by corresponding axles 44–47 on an elevator hoistway door 48. The movement of the solenoid actuator 14 may, if desired, be chosen to lower the vane 33 and raise the vane 34 sufficiently so that the links 22, 23 will be rotated just past the position at which the two vanes 33, 34 are at the maximal distance from each other, as shown in FIG. 4. This can be achieved by a tension spring 49, shown for convenience only in FIG. 4, which is attached to the car door side of the angles 21, 28 (the back in FIG. 4). With the links 22, 23 in the position shown in FIG. 4, there is no chance that the two arms will resume the uncoupled position shown in FIGS. 1 and 2 as a consequence of vibration and other mechanical shock resulting from the opening of the car door. The force required to open or close the doors is transmitted horizontally through the links 22, 23 and therefore does not tend to close the parallelogram.

When the car door 13 opens, by traveling to the left as seen in FIGS. 1–4, the shelf 20 will simply slide away from the bracket 16. Car door motion has no effect on the positioning of the blades 33, 34. The solenoid 14 may remain in an energized condition, with the shelf 20 in a fully lowered position (as in FIG. 4), so that the shelf 20 can slide back above it when the elevator door 13 is closed. Then, the solenoid 14 can be disenergized so the spring 17 will raise the shelf 20 and pull the angle 21 upwardly to the position shown in FIG. 1, thereby restoring the vanes 33, 34 into the uncoupled position shown in FIGS. 1 and 2. This provides clearance so that the elevator may travel upwardly and downwardly in the hoistway without contacting any of the rollers 40–43 (or similar rollers on other hoistway doors in the same elevator hoistway). The actuator 14 may be rotary or of some other configuration, so long as it can open the vanes without door motion. The nature of all of the details of the actuator 14, the ramp 19 and the surface 20 is a function of the particular installation in which the invention may be practiced.

In the disclosed embodiment, the bumpers comprise four rollers 40–43 arranged in pairs, each roller of a pair 41, 42, when coupled, being disposed essentially vertically above the other roller of the pair 41, 43, respectively. This provides the greatest degree of horizontal stiffness as well as rotational stiffness, thereby enhancing the ability of the linear induction motor 11, 12 to provide smooth, quiet motion to the car door 13 and the hoistway door 48. 0f course, the vanes 33, 34 need not be perfectly parallel to each other nor absolutely vertical; it suffice that the vanes can be wedged between suitable bumpers so as to provide horizontal and rotational stiffness between the elevator car door 13 and the hoistway door 48, as described.

The bumpers are preferably rollers 40, 43 disposed for rotation on corresponding axles 44–47 so as to permit relative vertical motion between the elevator car door 13 and the hoistway door 48 during advance door opening and, even after the door is opened, releveling of the elevator, as is known. However, instead of rollers 40–43, suitable self-lubricating bumpers, such as might be made of delrin or nylon, may be used if desired. The links 22, 23 are shown and described as being near the ends of the vanes 33, 34; however, that is deemed herein to include any suitable spacing along the vanes. The vanes are disposed to the links by the pivots on the other legs of the angles.

Figure 5:
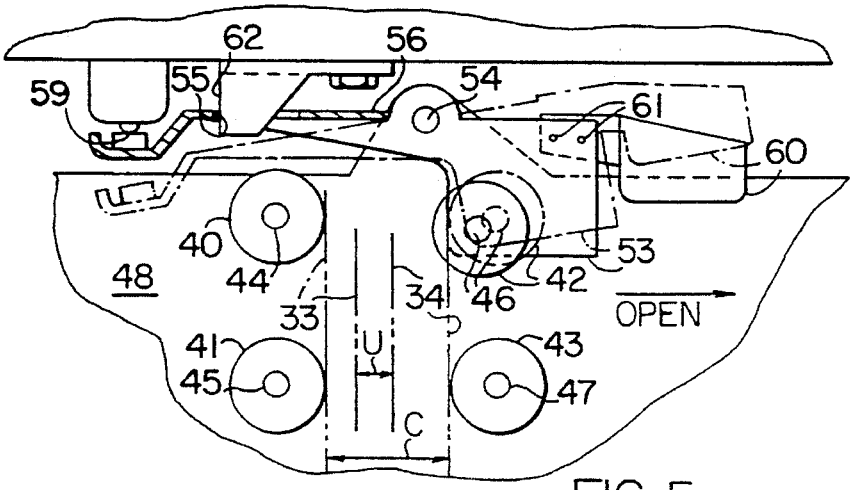
FIG. 5 is a simplified, partial, partially sectioned rear elevation view of the bumpers shown in FIG. 1, being a front elevation view of the apparatus disposed on a hoistway door.

Referring now to FIG. 5, the rollers 40–43 are being viewed oppositely to the view of them in FIG. 1. In FIG. 1, the view is toward the elevator car door, whereas in FIG. 5 the view is toward the hoistway door. In FIG. 5, the axle 46 is disposed for rotation on a switch/lock plate 53 which is rotatable about a pivot 54 in response to the vane 34 moving from the uncoupled position of FIGS. 1 and 2 ("U" in FIG. 5) into the coupled position of FIGS. 3 and 4 ("C" in FIG. 5). The pivot 54 is connected to the hoistway door 48. The resulting position of the switch/lock plate 53 is shown in dotted lines in FIG. 5. The switch/lock plate 53 has a lip 55 formed in a shelf 56 thereof, the shelf 56 extending outwardly to a point where it makes electrical contact between the safety switch contacts 59, in a well-known way. The plate 53 has a small weight 60 fastened thereto in any suitable way such as by rivets 61. The weight 60 ensures that the lip 55 will engage a latch 62 whenever the hoistway door 48 is moved to the closed position as shown in FIG. 5.

When the armature 14 is actuated, just prior to door opening, the spring 17 is compressed as seen in FIG. 4 and the spring 49 will cause the vanes 33, 34 to spread, thereby moving the roller 42 to the right as seen in FIG. 5, causing the plate 53 to rotate counterclockwise about the pivot 54 against the gravitational force of the weight 60. The action of the roller 42, the plate 53, the lip and latch 55, 62 and safety switch contacts 59 are all as is known in the prior art.

Figure 6:
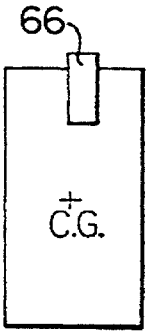
FIG. 6 is a simple illustration of the location of a door coupler in accordance with the invention.

However, in the prior art, only two rollers 40, 42 are utilized to couple the elevator car door to the hoistway door. In the prior art, the coupling device was mounted near the center of gravity (C.G., FIG. 6) or immediately above it. In FIG. 6, the coupler 66 of the present invention is mounted at the top of the hoistway door, above the center of gravity. The combination of mounting the coupler at the top of the hoistway door, vertically as near as possible to the point at which motion is imparted to the elevator car door by the linear motor 11, 12, together with providing the additional rollers 41, 43 for rotational stiffness (in addition to the lateral stiffness provided by only a single pair of rollers 40, 42) is shown to significantly reduce rocking of the doors as they are opened or closed, thereby eliminating noise and eliminating perturbations in the drive system for the linear motor 11, 12.

The spring 49 is shown schematically, only in FIG. 4, because it is a well known expedient. Other means of causing the vanes to spread apart as seen in FIG. 4 may be used if desired without departing from the invention herein. In FIGS. 1 and 4, it can be seen that the distance between the pivot 24 and the pivot 35 is one-half as great as the distance between the pivot 26 and the pivot 35. This is a known expedient that assists in moving the roller 42 (FIG. 5) so as to ensure that the hoistway door is unlatched before the car door begins to move it.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. Apparatus for coupling an elevator hoistway door at a floor landing to an elevator car door so that the two may be operated in unison, comprising:

a first set including a pair of vanes between said doors when said elevator car is within a landing zone of said floor landing;

a second set including a plurality of bumpers between said doors when said elevator car is within said landing zone, one of said sets disposed on said elevator car door and the other of said sets disposed on said hoistway door; and actuator means disposed on said elevator car for causing, when said elevator car is within said landing zone, relative motion between said bumpers and said vanes so as to cause said bumpers to rigidly engage said vanes, thereby coupling said doors together to be opened and closed in unison in response to motive force applied to said elevator car door, and for causing relative motion between said bumpers and said vanes so as to cause said bumpers to disengage said vanes and provide uncoupled clearance between said bumpers and said vanes;

characterized by the improvement comprising:

said plurality of bumpers including at least four bumpers disposed so that when said vanes are in said coupled position at least two of said bumpers engage each of said vanes, each bumper engaging a corresponding vane at a point displaced from the point at which a related bumper engages said corresponding vane, thereby providing rotational stiffness to said coupling.

2. Apparatus according to claim 1 wherein said bumpers are rollers disposed for rotation about horizontal axles.

3. Apparatus according to claim 1 wherein said bumpers are disposed on said hoistway door.

4. Apparatus according to claim 1 wherein said vanes are disposed on said elevator car door.

5. Apparatus according to claim 1 wherein said vanes are movable and said actuator means moves said vanes into engagement with said bumpers.

6. Apparatus according to claim 1 wherein said vanes and said bumpers are disposed at the center of the top of said doors.

* * * * *